US009899775B2

(12) United States Patent
Bergner et al.

(10) Patent No.: US 9,899,775 B2
(45) Date of Patent: Feb. 20, 2018

(54) CONNECTOR INSERT AND CONNECTOR FOR DATA TRANSMISSION IN AUTOMOBILES

(71) Applicant: TE Connectivity Germany GmbH, Bensheim (DE)

(72) Inventors: Bert Bergner, Bensheim (DE); Robert Wuerker, Frankfurt am Main (DE); Wolfgang Mueller, Darmstadt (DE); Christian Schellhaas, Zwingenberg (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/000,755

(22) Filed: Jan. 19, 2016

(65) Prior Publication Data

US 2016/0211622 A1 Jul. 21, 2016

(30) Foreign Application Priority Data

Jan. 19, 2015 (DE) ..... 10 2015 200 722

(51) Int. Cl.

| | |
|---|---|
| ***H01R 13/58*** | (2006.01) |
| ***H01R 13/6598*** | (2011.01) |
| ***H01R 13/424*** | (2006.01) |
| ***H01R 13/6592*** | (2011.01) |
| ***H01R 13/42*** | (2006.01) |
| *H01R 13/436* | (2006.01) |

(Continued)

(52) U.S. Cl.

CPC ..... *H01R 13/6598* (2013.01); *H01R 13/42* (2013.01); *H01R 13/424* (2013.01); *H01R 13/5808* (2013.01); *H01R 13/6592* (2013.01); *H01R 13/4361* (2013.01); *H01R 13/501* (2013.01); *H01R 13/518* (2013.01); *H01R 2201/26* (2013.01)

(58) Field of Classification Search

CPC ..... H01R 13/5845
USPC ..... 439/470, 472, 473, 474, 415, 445, 865, 439/867

See application file for complete search history.

(56) References Cited

U.S. PATENT DOCUMENTS 4,674,814 A * 6/1987 Hoshino ..... H01R 13/62 439/372
4,767,361 A * 8/1988 Hoshino ..... H01R 13/422 439/596

(Continued)

FOREIGN PATENT DOCUMENTS

| | | | |
|---|---|---|---|
| DE | 10 2012 023 952 | A1 | 6/2013 |
| JP | 722107 | A | 1/1995 |
| JP | 115595 | A | 1/1999 |

OTHER PUBLICATIONS

European Search Report, dated Jun. 10, 2016, 9 pages.

*Primary Examiner* — Phuong Dinh
(74) *Attorney, Agent, or Firm* — Barley Snyder

(57) ABSTRACT

A connector insert is disclosed. The connector insert has a cable including a plurality of wires, a plurality of plug contacts, a housing including at least one reception chamber defining an inlet, and a stabilizer including a first fastening location at which the stabilizer is attached to the housing and a second fastening location at which the stabilizer is attached to the cable. Each plug contact is attached to a wire, and the reception chamber accepts the plug contacts through the inlet. The stabilizer is composed of a dimensionally stable material.

17 Claims, 8 Drawing Sheets

(51) Int. Cl.
*H01R 13/518* (2006.01)
*H01R 13/50* (2006.01)

(56) References Cited

U.S. PATENT DOCUMENTS

| | | | | |
|---|---|---|---|---|
| 5,725,397 | A * | 3/1998 | Fukamachi | H01R 13/518 439/596 |
| 6,390,852 | B1 * | 5/2002 | Wang | H01R 13/6593 439/607.48 |
| 6,554,644 | B2 * | 4/2003 | Koide | H01R 9/0518 439/108 |
| 7,232,341 | B2 * | 6/2007 | Shinmyo | H01R 13/6592 439/607.51 |
| 2006/0110982 | A1 | 5/2006 | Shinmyo | |

* cited by examiner

CONNECTOR INSERT AND CONNECTOR FOR DATA TRANSMISSION IN AUTOMOBILES

CROSS-REFERENCE TO RELATED APPLICATION

This application claims the benefit of the filing date under 35 U.S.C. § 119(a)-(d) of German Patent Application No. 102015200722.7, filed Jan. 19, 2015.

FIELD OF THE INVENTION

The present invention relates to a connector, and more particularly, to a plug connector for data transmission in automobiles.

BACKGROUND

Data transmission via two-conductor systems is widely used in automobiles. In the two-conductor systems, two twisted conductors without shielding are used to transport data. This solution is simple and cost-effective. In addition, in two-conductor systems, cables with large cross-sections can be used which are better suited to the tough operating conditions in an automobile. However, the two-conductor systems are at a particular danger of breakdown in the region of plug connections.

SUMMARY

An object of the present invention, among others, is to improve the durability of a data-transmitting connector insert. The disclosed connector insert has a cable including a plurality of wires, a plurality of plug contacts, a housing including at least one reception chamber defining an inlet, and a stabilizer including a first fastening location at which the stabilizer is attached to the housing and a second fastening location at which the stabilizer is attached to the cable. Each plug contact is attached to a wire, and the reception chamber accepts the plug contacts through the inlet. The stabilizer is composed of a dimensionally stable material.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector insert. This invention may, however, be embodied in many different forms and should not be construed as limited to the embodiments set forth herein; rather, these embodiments are provided so that this disclosure will be thorough and complete and still fully convey the scope of the invention to those skilled in the art.

A connector insert 1 according to an embodiment of the invention will be described with reference to FIGS. 1-4. The connector insert 1 has a housing 2, a two-core cable 6, and a stabilizer 22. The major components of the invention will now be described in greater detail.

Figure 1:
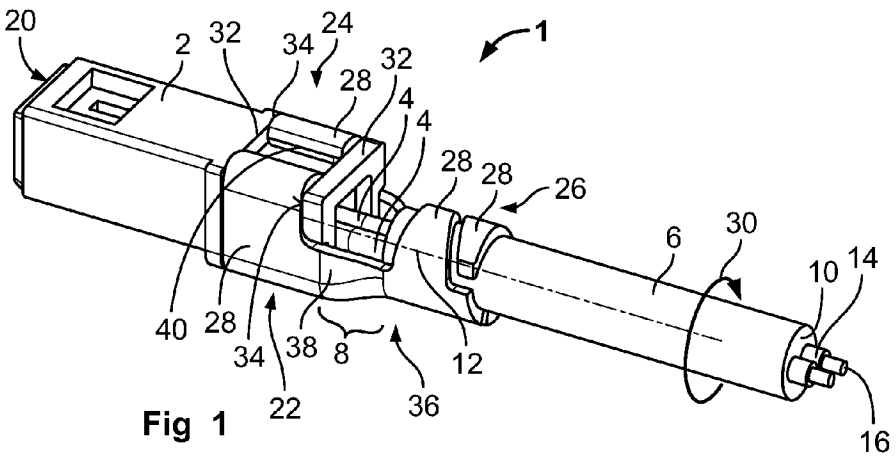
FIG. 1 is a perspective view of a first embodiment of a connector insert according to the invention.
Figure 2:
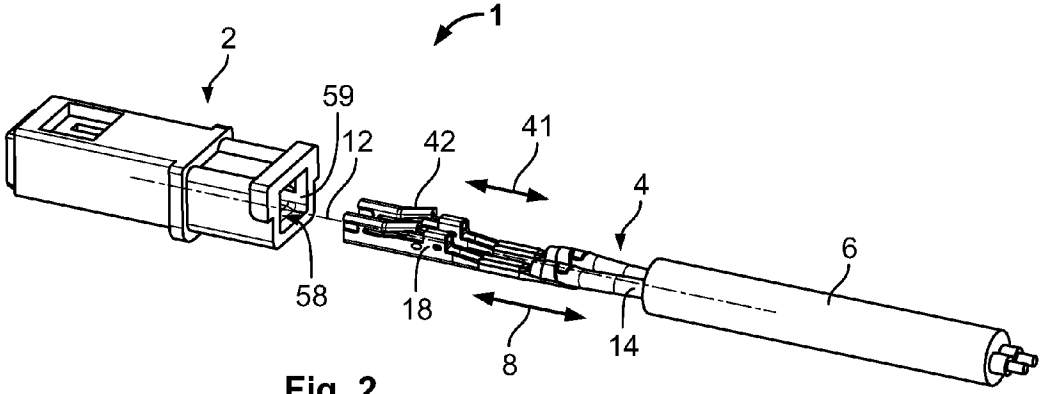
FIG. 2 is an exploded perspective view of a cable and housing of the embodiment of FIG. 1.
Figure 3:
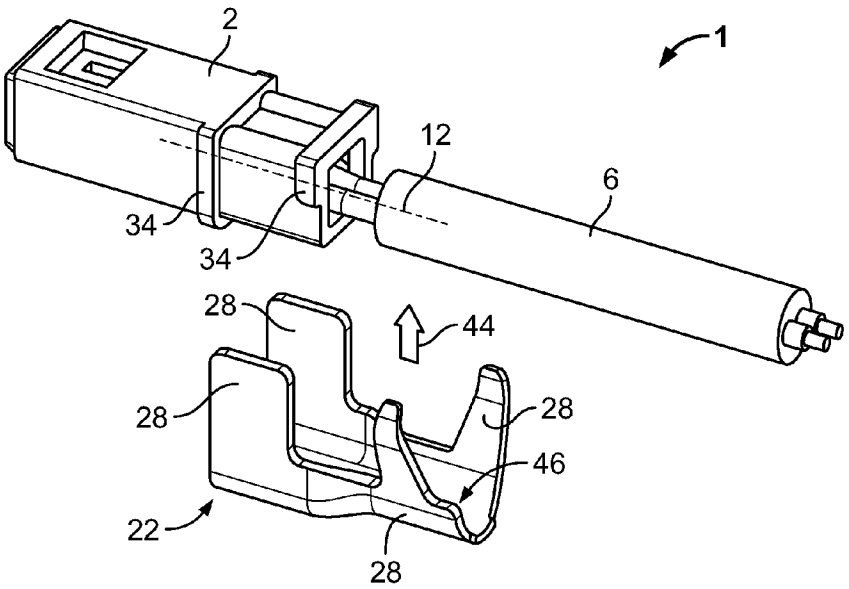
FIG. 3 is an exploded perspective view of the embodiment of FIG. 1.

At the end opposite the cable 6 in the longitudinal direction 12, the housing 2 has a plug face 20. As shown in FIGS. 1 and 3, the housing 2 has at least one shoulder 32 which has a stop surface 34 which points in or counter to the longitudinal direction 12. An inlet 59 defined in a reception chamber 58 in an end of the housing 2 extends along the longitudinal direction 12, as shown in FIG. 2. The housing 2 is optionally made of plastics material.

The wires 4 of a two-core cable 6 in this embodiment lead into the housing 2. In a region 8, before the wires 4 enter the housing 2, a sheathing 10 of the cable 6 is removed and the wires 4 are exposed. The length of the region 8 in the longitudinal direction 12 of the wires 4 or of the connector insert 1 may be around 10 mm. In the region 8, the wires 4 are still equipped with their insulations 14; conductors 16 of the wires 4 are only exposed within the housing 2.

The wires 4 can be stripped of their insulation at their ends so that the conductors 16 are exposed. Each wire 4 is firmly connected to a plug contact 18 in a conductive and mechanical manner, as shown in FIG. 2, for example by crimping. The plug contacts 18 can be configured as bushings or pins, and are insulated from one another in the housing 2. The plug contacts 18 may be equipped with catching means 42 in the form of apertures.

The stabilizer 22 is made from a dimensionally stable material, such as sheet metal, for example, or other stable materials known to those with ordinary skill in the art. The stabilizer 22 may be a stamped bent part made of these materials. The stabilizer 22 has two crimping wings 28 which are situated opposite one another at fastening location 24, as shown in FIG. 3. Instead of the two opposing crimping wings 28, it is obviously also possible for only one single, but longer, crimping wing to be employed. In the embodiment shown, there are also two crimping wings 28 at the fastening location 26 at the cable. The crimping wings 28 at the fastening location 26 can, for example, taper in the direction of their free end, such that they become narrower, when viewed in the circumferential direction 30 of the wires 4. The side walls 38 of the stabilizer 22 merge towards the end at the housing into the crimping wings 28 of the fastening location 24. At the end at the cable, the side walls 38 can continue into the crimping wings 28 of the fastening location 26. The cross-section of the stabilizer 22 is U-shaped transverse to the longitudinal direction 12, formed by its trough shape and the side walls 38. The crimping wings 28 of the stabilizer 22 can run parallel to one another or in a splayed manner before mounting.

In the depicted configuration of FIGS. 1-4, the connector insert 1 serves to transmit data in an automobile by means of a two-wire system, as shown by the two wires 4 of the cable 6. A connector 1, as would be appreciated by one with ordinary skill in the art, can also receive more than two wires 4, in which case only the number of plug contacts 18 increases and the geometry of the housing 2 and of the stabilizer 22 must be appropriately adapted.

The wires 4 are twisted in the cable 6 so that they have only low interference sensitivity. This twisting is removed in the region 8 so that not only the mechanical sensitivity but also the sensitivity to electromagnetic interference fields is increased there.

After the cable 6 is ready for use at its end pointing towards the housing 2, i.e. the sheathing 10 is removed in the region 8 so that the wires 4 are exposed and their insulation 14 is removed at the end of the wires 4 and the conductors 16 are exposed, the plug contacts 18 are connected to the wires 4. One plug contact 18 is fastened to each wire 4, the conductors 16 also being conductively connected to the plug contact 18. The fastening can be produced by one or more crimp connections. Then the plug contacts 18 are pushed in a push-in direction 41 through the inlet 59 in a reception chamber 58 in the housing 2. The plug contacts 18 can be equipped with catching means 42 in the form of apertures for receiving catching lugs at the housing or (as in the embodiment shown) in the form of resiliently deflectable catching protrusions which engage in apertures at the housing. The plug contacts 18 engage automatically as soon as they are pushed sufficiently deeply into the housing 2.

To additionally secure the plug contacts 18 in the housing 2, a contact securing member can be present in further configurations. Such a contact securing is described in greater detail below in connection with a different example of a configuration of a connector insert 1.

After the plug contacts 18 are secured in the housing 2, the stabilizer 22 is, as shown in FIG. 3, pushed in a joining direction 44 transverse to the longitudinal direction 12 onto the housing 2 and the cable 6, as indicated by the arrow. As further shown in FIG. 1, the stabilizer 22 can be arranged in a recess or hollow 40 of the housing 2, such that it does not project out of the cubic volume of the housing 2. This ensures a backward compatibility of the connector insert 1, such that it can be widely used despite the additional stabilizer. In this configuration, the stabilizer 22 forms a trough-shaped channel into which the housing 2 and the cable 6 are laid.

The stabilizer 22 has at least one fastening location 24 at the housing and at least one fastening location 26 at the sheathing 10 of the cable 6. In particular at the fastening location 24 at the housing, the stabilizer 22 can be retained in a force-fitting manner, for example, by a crimping and/or in a form-fitting manner. At fastening location 24, two crimping wings 28, in a circumferential direction 30 running around the longitudinal direction 12, enclose the housing 2 in the crimped state at at least three sides, or generally in a wrapping of more than 180°. To form a form-fit restricting motion in the longitudinal direction 12, the shoulder 32 and stop surface 34 of the housing 2 are situated opposite the corresponding mating surfaces of the stabilizer 22. These mating surfaces can be formed by the crimping wings 28, for example. The shoulders 32 can act as guides which facilitate the exact assembly of the arrangement with the housing 2 and cable 6.

Figure 4:
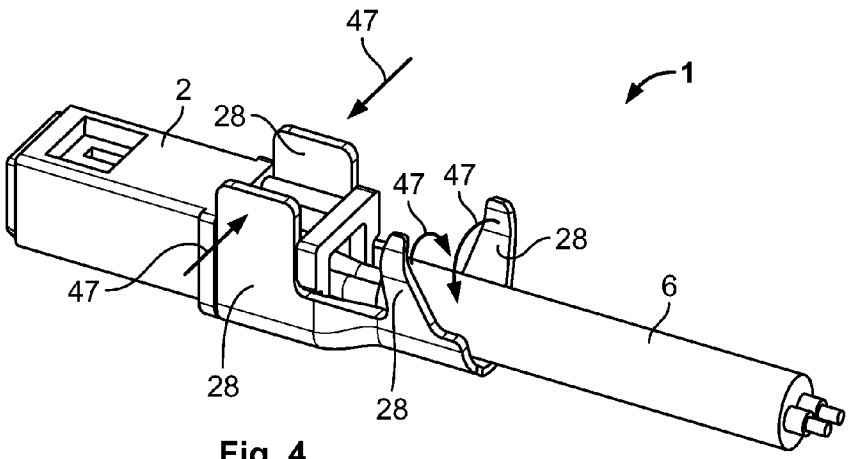
FIG. 4 is a perspective view of the embodiment of FIG. 1.

Crimping wings 28 at fastening location 26 can be configured such that they overlap each another in the longitudinal direction and each have a wrapping angle of more than 360°. As a result, each single crimping wing 28 secures the stabilizer 22 independently of the other crimping wing 28 on the cable 6. FIG. 4 shows how the cable 6 and the housing 2 are laid in the stabilizer 22. The crimping wings 28 are then folded over, as indicated by the arrows 47, to produce the configuration shown in FIG. 1. The stabilizer 22 acts as protection for the wires 4 and as relief from pulling, so that the exposed wires 4 are retained in a manner which is secured against pulling and protected from kinking.

The region 8, in which the wires 4 are exposed, is bridged by the stabilizer 22 by a section which forms a type of trough 36 for the wires 4. The wires 4 do not necessarily have to rest on the base of the trough. However, the trough 36 has, on both sides, side walls 38 which optionally extend to above the wires 4. The trough 36 broadens from the cable 6 to the housing 2. The trough 36 can be open at its end at the cable and/or its end at the housing. The housing 2 can be placed into the trough 36, just like the cable 6.

The u-shape of the stabilizer 22 not only protects the wires 4, but due to this cross-section shape is also very stiff, such that it can compensate for forces which act transverse to the longitudinal direction 12 on the cable 6. When such transverse forces take effect, the crimping wings 28 at the fastening location 24 at the housing can be supported on the shoulders 32 and thus form torque supports. The form-fit consequently strengthens the crimp connection at the fastening location 24 at the housing.

The stabilizer 22 increases not only the mechanical strength, but rather, if it is made, for example, from a magnetically soft and optionally ferromagnetic material, shields the wires 4 in the region 8 by overlapping the cable sheathing 10 in a region in which the wires 4 are twisted. At the housing 2, the stabilizer 22 overlaps the plug contacts 18 located there. A high wrapping angle of the stabilizer 22 also increases the shielding effect in addition to the mechanical strength.

The plug face 20 is formed in order to produce a plug connection of the plug contacts 18 with the mating contacts (not shown) of a mating plug which is also not shown.

Figure 6:
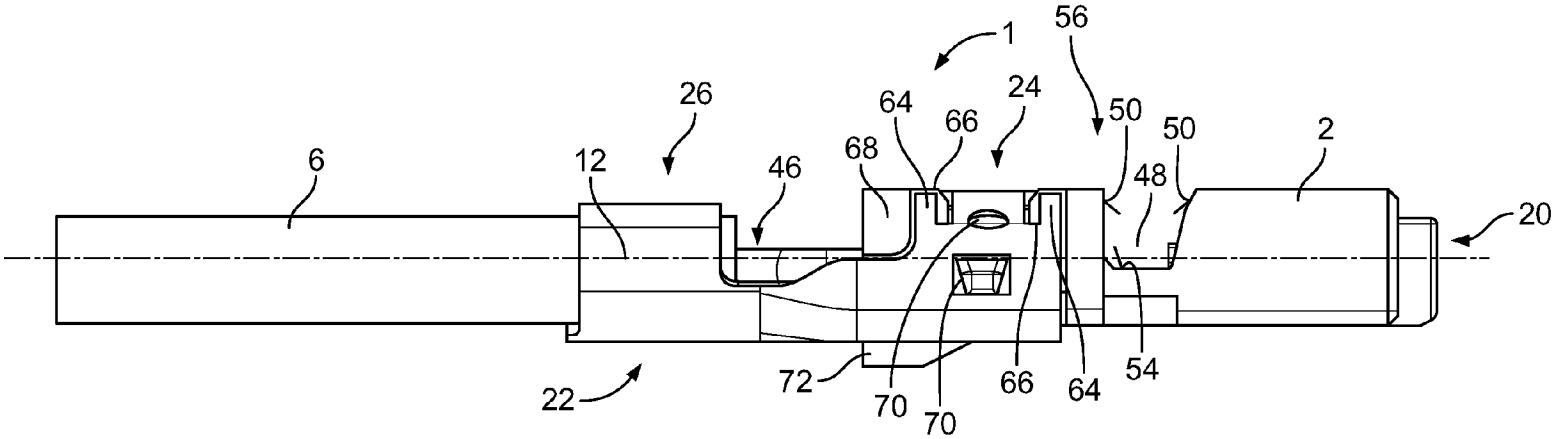
FIG. 6 is a side view of the embodiment of FIG. 5.

Another embodiment of a connector insert 1 is depicted in FIG. 6. For the sake of conciseness, only the differences relative to the preceding embodiment are discussed below.

The embodiment of FIG. 6 differs from the connector insert 1 of the first embodiment in particular in terms of the configuration of the two fastening locations 24, 26 of the stabilizer 22 and the configuration of the housing 2. The housing 2 is equipped with a securing groove 48 which runs transverse to the longitudinal direction 12. The two side walls 50 of the securing groove 48 point in and counter to the longitudinal direction 12, respectively.

The securing groove 48 can in particular extend continuously over the entire width 52, so that it is open at its two ends. The plug contacts 18 can run at the base 54 of the securing groove 48. The plug contacts 18 can be situated in particular in recesses of the housing 2, such that they do not project beyond the portion of the base 54 formed by the housing 2 into the securing groove 48.

The plug contacts 18 are accessible in the securing groove 48 from outside, in particular from a direction transverse to the longitudinal direction 12. The securing groove 48 can in this manner serve as a testing aperture 56 through which a measurement device can electrically contact the plug contacts 18. This makes it possible to test the connection between the conductors 16, shown in FIG. 1, and the plug contacts 18 when the connector insert 1 is complete.

Alternatively or in addition, a further testing aperture 56' can offer access from the outside to a region of the plug contacts 18. In particular, a separate testing aperture 56 can be provided for each plug contact 18. This further testing aperture 56' can be arranged at the other side of the stabilizer 22 closer to the end of the housing 2 opposite the cable 6, i.e. closer to the plug face 20. The additional testing aperture 56' can at the same time represent an aperture at the housing, in which the latching means 42 of the plug contacts 18 latches.

The securing groove 48 can in particular extend through one or more reception chambers 58 of the housing 2, in which the plug contacts 18 are received. A securing protrusion 60 of the plug contacts 18, which is at least approximately in alignment with one of the side walls 50, optionally the side wall which points toward the cable 6, is adjacent the securing groove 48. A further securing protrusion can be present on the opposite wall 50 of the securing groove 48. The plug contact 18 can be additionally secured in the housing 2 by the two securing projections 60 if a locking body (not shown in FIGS. 5 to 10) is inserted into the securing groove 48. The locking body situated in the securing groove 48 forms a form-fit, acting in the longitudinal direction 12, with the protrusions 60 which prevents the plug contacts 18 from being pulled out and/or excessively pressed in.

The shape of the crimping wings 28 and of the recess 40 of the housing 2 differs in the embodiment of FIG. 6.

On the fastening location 26 at the cable, the crimping wings 28 are equipped with form-fitting elements 62 which are complementary to one another and which engage in one another when the crimping connection is complete. For example, one form-fitting element can be formed as a protrusion projecting in the circumferential direction 30 (FIG. 1) and the other form-fitting element 62 can be formed as a cavity which is configured in a correspondingly complementary manner. When the crimping connection is complete, the protrusion is in the cavity. The form-fitting elements ensure an exact crimping connection and secure the two crimping wings 28 in their crimped position against one another.

Furthermore, the wrapping angle of the crimping wings 28 at the fastening location 26 at the cable is smaller than in the embodiment of FIG. 1, where the free ends of the wings 28 come to rest opposite the base 46 of the stabilizer 22.

At the fastening location at the housing too, the crimping wings 28 in the embodiment of FIG. 6 are configured differently than in the embodiment of FIG. 1. Thus, the crimping wings 28 have, in particular at their free ends, lugs 64 which protrude in the longitudinal direction 12. The lugs 64 are received in complementary pockets 66 of the housing 2. The lugs 64 and pockets 66 can, for example, have a rectangular, in particular square, surface area. The lugs 64 can be present on at least three sides of the housing 2.

At the housing's upper side which is opposite the base 46 of the stabilizer 22, the lugs 64 can protrude in the opposite direction from the crimping wings 28. In this case, the free end of each crimping wing 28 is equipped with a lug 64 in each case. The lugs 64 of the two crimping wings 28 can, with regard to the longitudinal direction 12, protrude in the opposite direction.

At the other two side surfaces 68 of the housing 2, one lug or a pair of lugs 66 can protrude in the direction away from the base 46 of the crimping wing 28. This at least one wing 64 is also received in a pocket 66. Each wing 64 is optionally retained in a form-fitting manner in at least two, or in some embodiments at least three, directions by the pocket 66 which is complementary to it.

The lugs 64 act in particular as torque supports in the event of bending and torsion loads on the cable 6. At the same time, during preassembly they ensure that the stabilizer 22 fits accurately at the housing 2.

Figure 5:
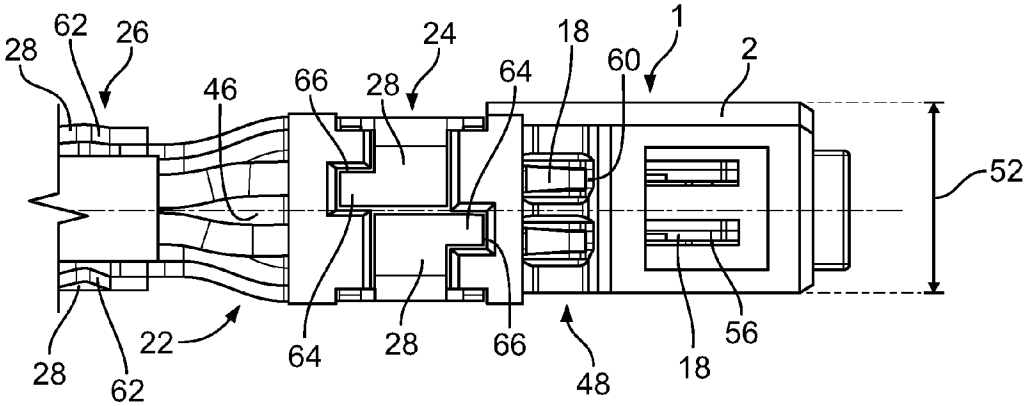
FIG. 5 is a top view of a second embodiment of a connector insert according to the invention.

Modifications are conceivable in the embodiment of FIG. 5. For example, the lugs 64 at the side walls 68 may not protrude transverse to the longitudinal direction 12 as shown, but rather in or counter to the longitudinal direction 12. However, this would hamper the insertion of the housing 2 into the stabilizer. The lugs 64 at the side walls 68 may extend in the direction 44, shown in FIG. 3, in which the stabilizer 22 is placed on the housing and cable. The lugs 66 at the side walls 68 can further facilitate the application of a crimping tool (not shown) and thus the assembling.

In the embodiment of FIG. 5, the stabilizer 22 and the housing 2 are ultimately latched to one another by at least one latching means 70. For example, in the region of the crimping wings 28 there may be holes through which the latching protrusions of the housing 2 project when the stabilizer 22 is latched. Alternatively, at the stabilizer 22, above all in the region of the side surfaces 68, there can be stamped tongues which catch in corresponding apertures of the housing. Optionally, at least one, and occasionally also two, catching means 70 are provided at both opposing side surfaces 68.

At the region covered by the stabilizer 22, the housing 2 can further have a housing protrusion 72 which extends through the stabilizer and protrudes outwardly over the stabilizer 22. The housing protrusion 72 guides the stabilizer 22 during insertion into a connector (not shown in FIGS. 5 to 10) and additionally secures it in the longitudinal direction 12. At the same time, it serves to latch the housing 2 if the connector insert 1 is inserted into a connector 80.

The production of a connector insert 1 according to the embodiment of FIG. 6 is described below with reference to FIGS. 5 and 7-10. Here too, again for the purpose of conciseness, as far as possible only the differences from the embodiment of FIG. 1 or its production method according to FIGS. 2 to 4 are discussed.

Figure 7:
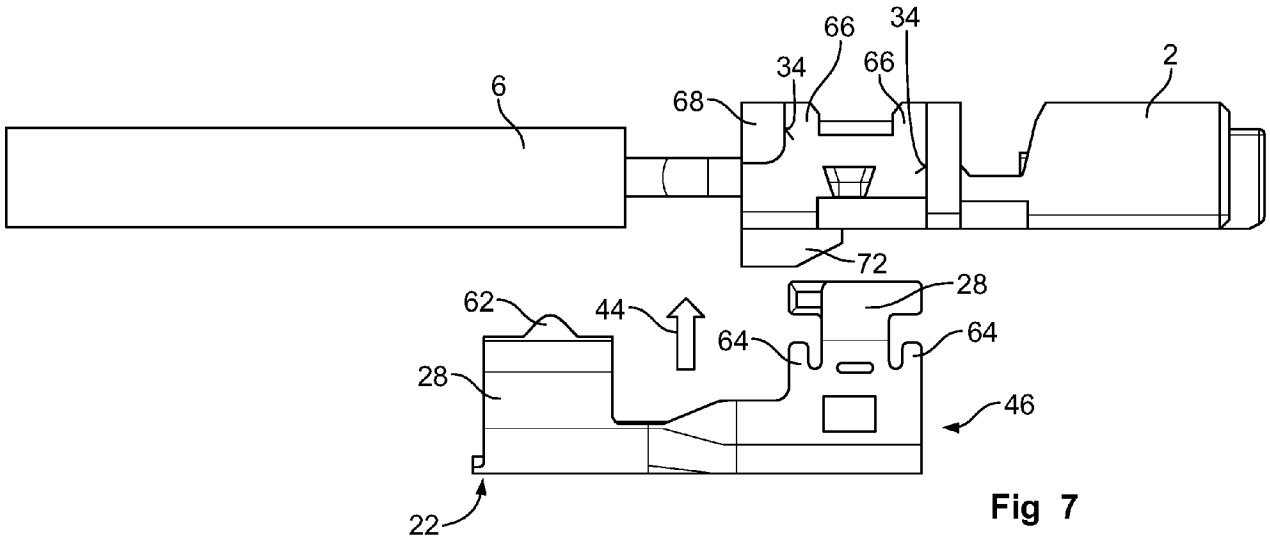
FIG. 7 is an exploded side view of the embodiment of FIG. 5.

As depicted in FIG. 7, the stabilizer 22 is pushed onto the housing 2 and cable 6 in arrow direction 44 and in the process is guided by the lugs 64 and pockets 66 and the shoulders 34 onto the side surfaces 68 and the housing protrusion 72 in the direction of the arrow 44, transverse to the longitudinal direction 12.

Figure 8:
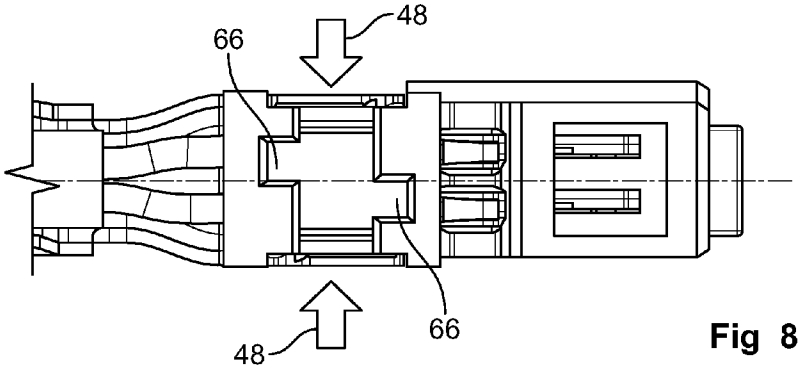
FIG. 8 is a top view of the embodiment of FIG. 5.
Figure 9:
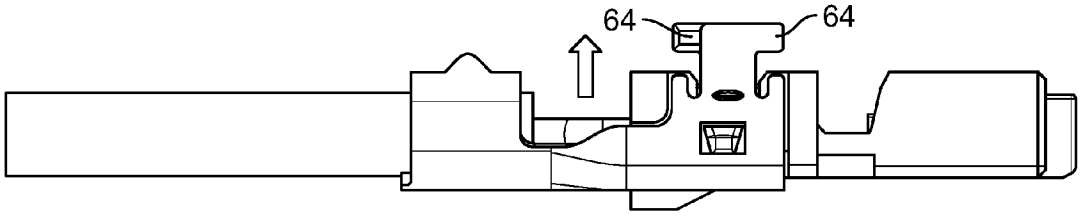
FIG. 9 is a side view of the embodiment of FIG. 5.

The crimping wings 28 at the fastening location 24 at the housing abut the side surfaces 68. In a latching position or pre-assembly position, if the housing 2 is positioned on the base 46, the latching means 70 of the housing 2 and stabilizer 22 are latched onto one another. The stabilizer 22 is therefore stably retained in the pre-assembly. This state is shown in FIGS. 8 and 9. Now the crimping wings 28 at the housing only have to be bent until the lugs 64 lie in the pockets 66 (see FIGS. 5 and 10), before finally the crimping wings 28 at the cable are then bent. The connector insert, as depicted in FIG. 6, is then finished. The crimping sequence can obviously also be reversed, i.e. first the crimping wings 28 at the cable, and then the crimping wings at the housing. It is also possible for the crimping wings 28 at the housing and at the cable to be crimped simultaneously.

Figure 10:
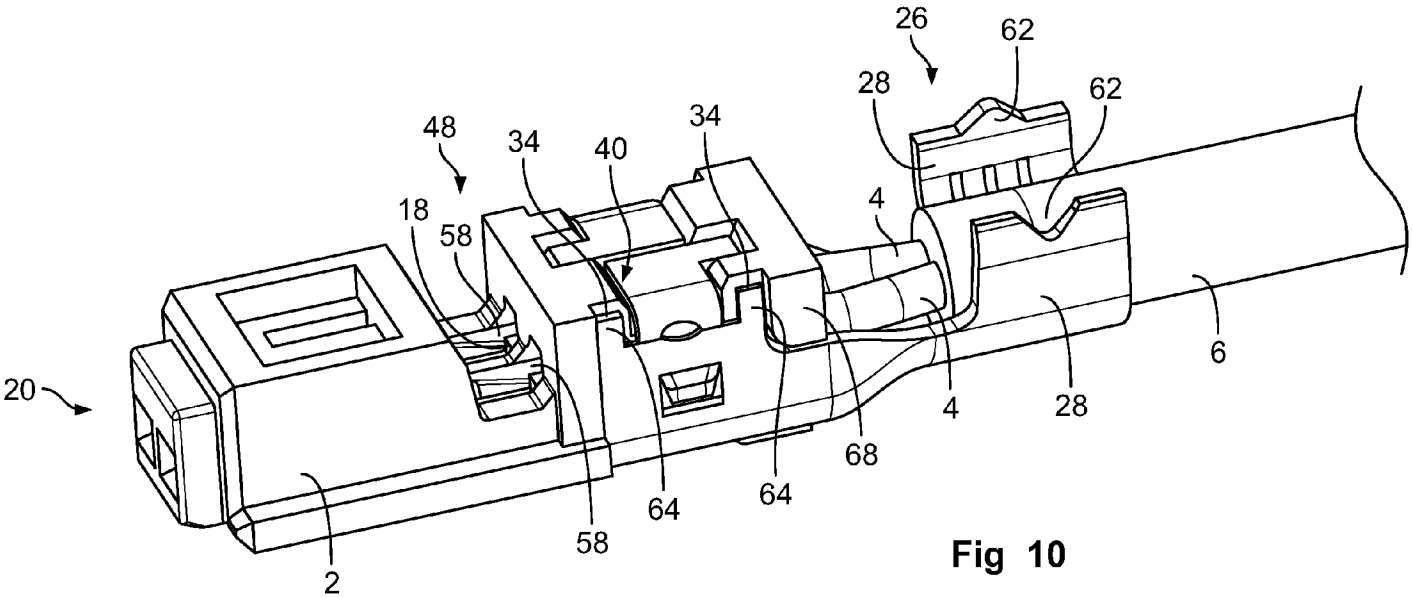
FIG. 10 is a perspective view of the embodiment of FIG. 6.

In FIG. 10, the embodiment of FIG. 6 is depicted once again for illustration in a schematic perspective view, wherein the fastening location 26 at the cable is not yet crimped. The form-fitting means 62, which are complementary to one another, for form-fitting to the crimping wings 28 of the fastening location 26 at the cable can be clearly recognized. Purely by way of example, they are formed as an at least approximately triangular protrusion 62 and an at least approximately triangular cavity 62.

In this depiction it is possible to also recognize the reception chambers 58 of the connectors 18 and the plug face 20. As further shown in FIG. 10, it is possible to dispense with pockets 66 for the lugs 64 on the side surfaces 68 as long as at least one side of the lugs 64 is supported on a shoulder 34.

In this embodiment too, the stabilizer 22 is situated completely in a recess 40 so that it does not project out of the cubic volume of the housing 2.

Figure 12:
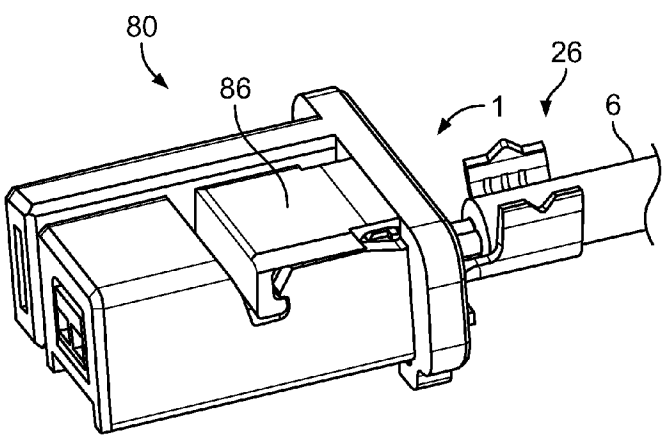
FIG. 12 is a perspective view of a secured connector of FIG. 11.
Figure 11:
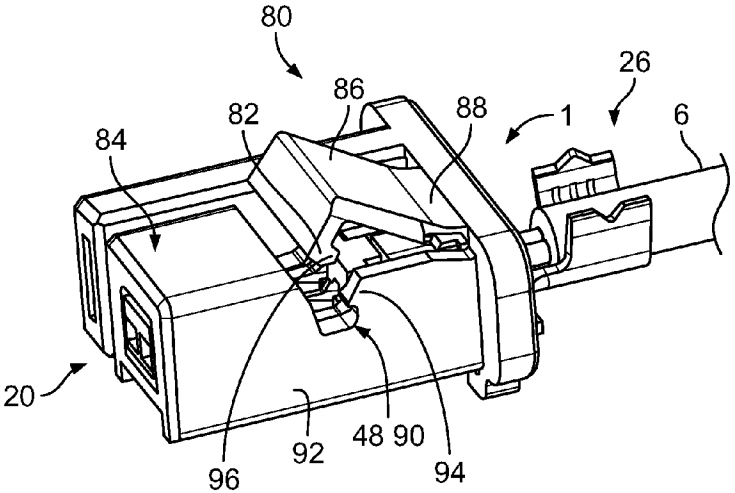
FIG. 11 is a perspective view of an unsecured connector of the embodiment of FIG. 1.

With reference to FIGS. 11 and 12, a connector 80 is described below, into which a connector insert 1 in particular according to the second embodiment of FIG. 6 can be inserted. The connector insert 1 is depicted merely by way of example in the state depicted in FIG. 10, with the fastening location 26 at the cable not yet complete. The connector 80 can have one or more receptacles for one or more connector inserts 1.

The connector inserts 1 can in particular extend through the entire connector 80 and form a part of the plug face 20 of the connector 80 at the end of the connector 80 facing the cable 6. Various standardized plug forms can be combined with one another in the plug face 20 of the connector 80. At least some of these standardized plug types can be formed by connector inserts 1.

The connector 80 has a retaining lug 82 which is movable into the securing groove 48 of the connector insert 1 and is optionally able to be arrested there. The retaining lug 82 acts as a locking body which secures the connector insert 1 and the plug contact 18 in the connector insert 1 at the same time. In addition to this securing, the connector insert 1 can also be latched in the connector 80. Thus, the connector insert 1 can be connected in a form-fitting manner, for example can be latched, to the connector housing 84 via the housing protrusion 72.

The retaining lug 82 can be arranged at a housing element 86 which is in particular foldably articulated to the connector housing 84. The articulation can ensue by means of an integral hinge 88, produced by injection moulding, at a side of the housing 84 facing the cable 6.

The connector housing 84 can have a housing groove 90 which is at least approximately in alignment with the securing groove 48 of the at least one connector element 1 and which can extend up to a side wall 92 of the housing 84. The housing 84 latches with the housing element 86, when the retaining lug 82 is completely introduced into the securing groove 48 of the at least one connector insert 1. For example, a protrusion 94 at the housing 84 can, in the latched state, engage, from behind, a protrusion 96 of the retaining lug 82, which protrusion 96 protrudes in particular in the direction of the cable 6. The retaining lug 82 may be automatically driven into the securing groove 48.

FIG. 12 shows the connector 80 with the latched housing element 86. The housing element 86 forms an outer wall of the connector 80. The connector 80 can now, for example, be fastened to a console (not shown) or can be plugged together with a mating plug retained at such a console.

The connector 80 with a corresponding configuration can receive alongside one another a plurality of connector inserts 1 which are orientated at least approximately in alignment with their securing grooves 48. Through a correspondingly wider retaining lug 82, by shutting the housing element 86, a plurality of connector inserts 1 can then be simultaneously secured to the plug contacts 18 received therein.

Figure 13:
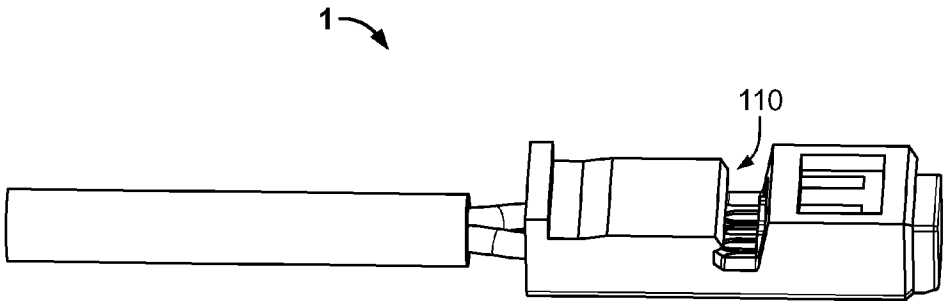
FIG. 13 is a perspective view of another embodiment of a connector.

FIG. 13 shows a simplified connector insert 1 without the stabilizer 22. Except for the missing stabilizer 22, this connector insert 1 corresponds to the connector inserts described above.

Figure 14:
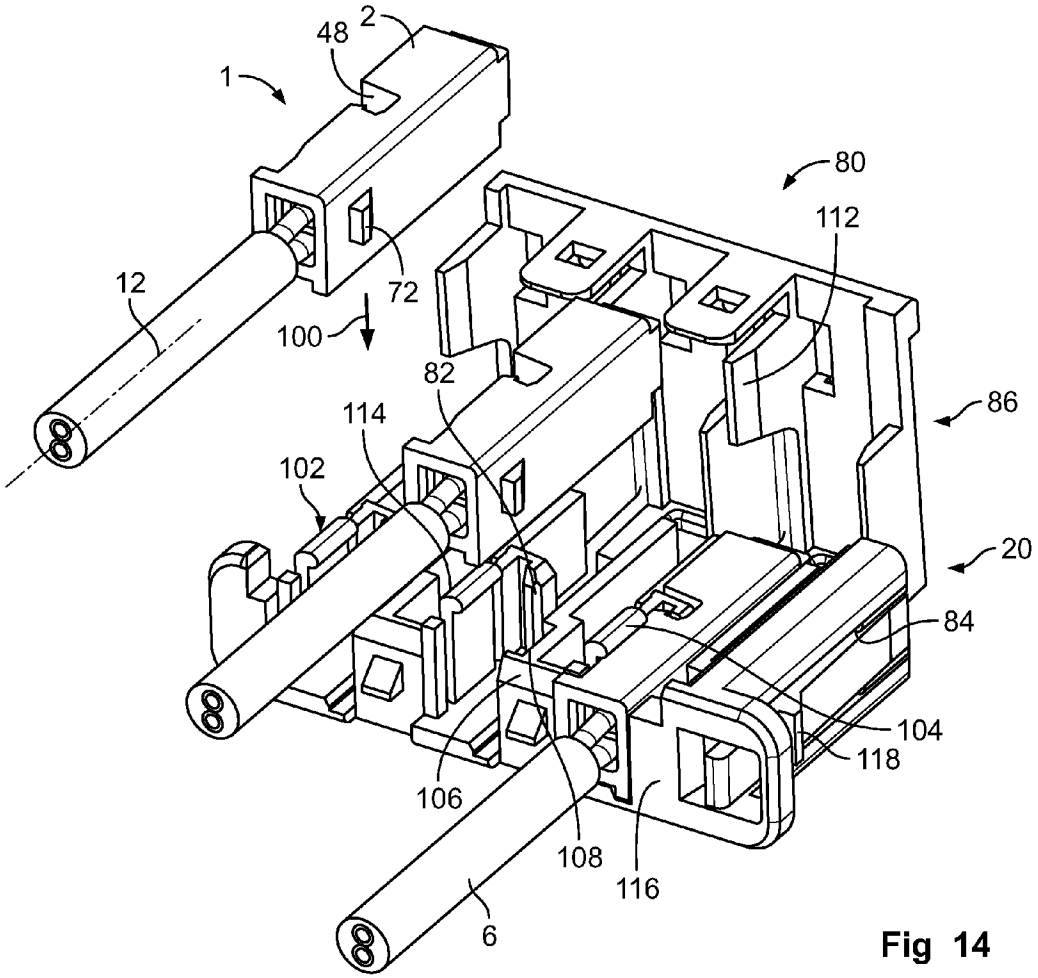
FIG. 14 is a perspective view of another embodiment of a connector with several connectors of FIG. 12.
Figure 15:
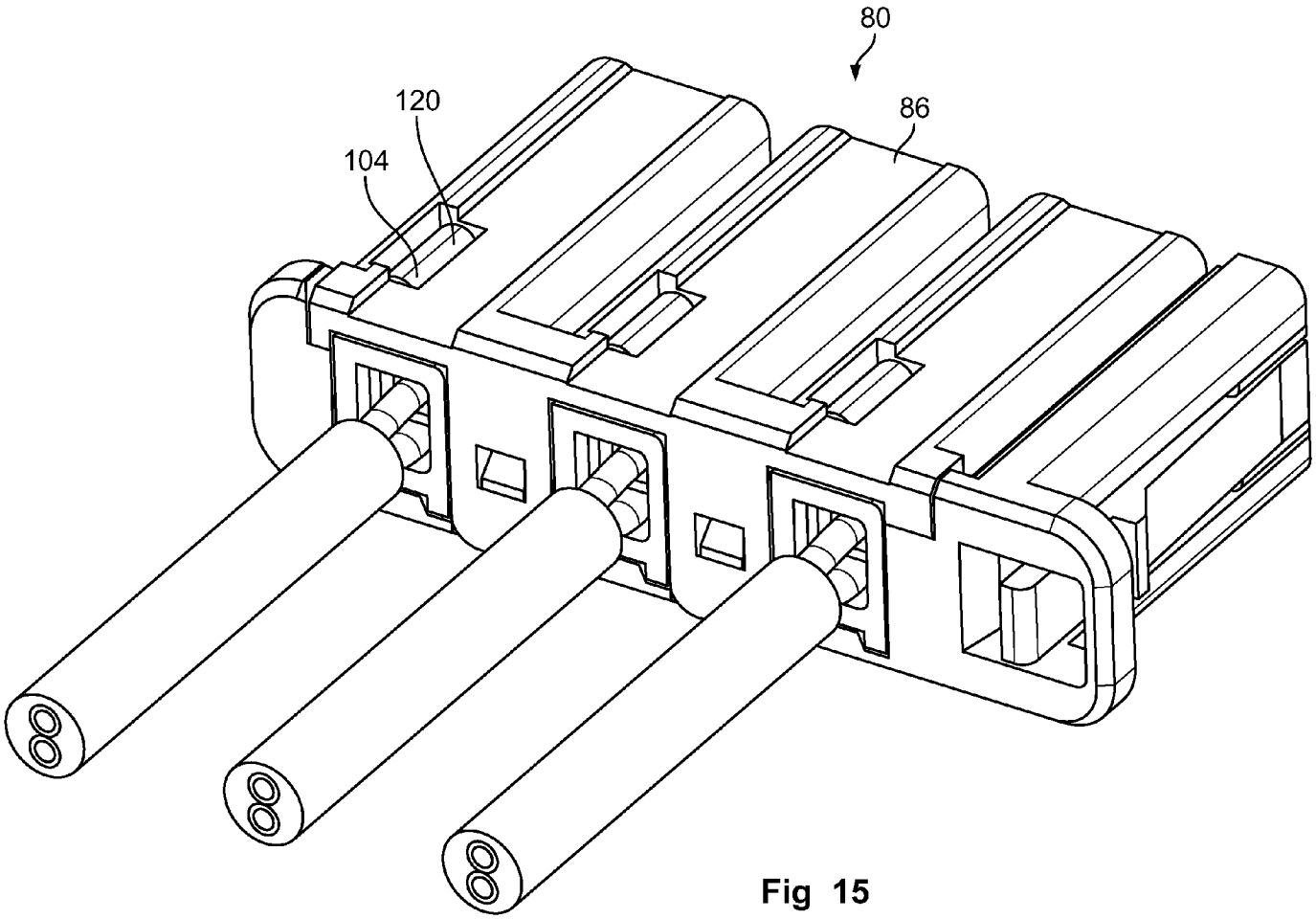
FIG. 15 is a perspective view of a secured position of the embodiment of FIG. 14.

The connector insert of FIG. 13 can, like the connector inserts of FIG. 6, be used in a variant of the connector 80, as is depicted in FIGS. 14 and 15 and may be the subject-matter of its own invention independent of a shape stabilizer 22. The connector 80 of FIG. 13 is configured only for viewing purposes for receiving three connector inserts 1. However, it can also be configured for receiving only one single connector insert 1 or any desired number of connector inserts 1. Here again too, only the differences from the preceding embodiment of the connector 80 will be discussed.

In contrast to the connector 80 of FIGS. 11 and 12, the connector inserts 1 are not inserted in the longitudinal direction 12, but rather in an insertion direction 100, which runs transverse to the longitudinal direction 12, into the connector 80 or into the receptacle 102 which is complementary to the connector insert 1. FIG. 14 shows the three connector inserts 1 in different phases of insertion. The connector insert 1 to the far right is already completely inserted into the corresponding receptacle 102, whilst the other two connector inserts 1 are remote from the connector 80 to different extents.

In contrast to the embodiment of FIG. 11, the connector inserts 1 are not orientated in alignment with their securing grooves 48. On the contrary, the securing grooves 48 in the case of each connector insert 1 run parallel to the insertion direction 100.

The connector 80 thus has retaining lugs 82 which can be configured to be identical to the retaining lugs 82 of the connector 80 of FIGS. 11 and 12. However, these retaining lugs 82 are a firm and immobile part of the connector housing 84. The retaining lug extends in the push-in direction 100 such that, when a connector insert 1 is inserted into a receptacle 102, the retaining lug 82 is pushed into the securing groove 48 and secures the connector insert 1 together with the plug contacts 18 arranged therein in the longitudinal direction 12. In addition, the connector insert 1 can be secured in the respective receptacle 102 by a latch 104. The latch 104 extends over the entire width of the housing 2 transverse to the longitudinal direction 12 and secures the connector insert 1 against removal from the receptacle 102 against the direction of insertion 100.

The form-fitting securing of the connector insert 1 by the retaining lug 82 can be supported by the housing protrusion 72 which is supported at a shoulder 106 against pulling on the cable 6. The shoulder 106 is formed by a pocket 108, which is open counter to the push-in direction 100, for receiving the housing protrusion 72.

In contrast to the preceding embodiment, the securing groove 48 can have an undercut 110, for example at the side wall 50 which is at the cable and which is engaged from behind by a corresponding protrusion 96 of the retaining lug 82.

The connector housing 80 of FIG. 14 is also provided with a foldable housing element 86. However, the housing element 86 is optionally articulated on the side of the plug face 20 of the connector 80 so that the connector inserts 1 can be laid into the receptacle 102 without any problems.

The housing element 86 is provided with protrusions 112 which block the latch 104 when the housing element 86 is folded in, and thus secure the connector insert 1 in the housing even when strong transverse forces act on the cable 6. For this purpose, the receptacle 102 is equipped with a pocket 114 which is situated behind the latch 104 and in which the protrusion 112 is received when the housing element 86 is folded shut. As a result, the protrusion 112 prevents the unintentional releasing of the latch 104 by blocking this in a form-fitting manner.

In the folded-shut state, the housing element 86 is latched at a front face 116 of the connector 80, which front face points towards the cable 6. Further catching means 118 of the connector 80 can be used for fastening to a mating plug or a console.

As would be appreciated by one with ordinary skill in the art, the housing element 86 does not have to be articulated. The housing element 86 can also be a separate component which is simply placed onto the housing 84.

In FIG. 15, the housing element 86 is shown in the folded-shut and latched state. The housing element 86 forms an outer surface of the connector 80. A viewing window 120 enables visual inspection of the latch 104 from the outside.

It should be noted that in the embodiment of FIGS. 11 and 14 the retaining lug 82 in each case can only be introduced into the securing groove 48 of the connector insert 1 if the plug contacts 18 are correctly mounted in the housing 2 of the connector insert 1 and are in their end position. If this is not the case, the protrusions 60 of the plug contacts 18 are situated in the securing groove 48 and block them. The same applies to the embodiments of FIGS. 1 to 10.

The protrusions 112 of the housing 86 can only be introduced into the pockets 114 if the latch 104 is correct. If the latching 104 is not carried out correctly, the pocket 114 situated behind it is not sufficiently large to receive the protrusion 112.

What is claimed is:

1. A connector insert, comprising:

a cable having a plurality of wires;

a plurality of plug contacts, each plug contact attached to a wire;

a housing having at least one reception chamber defining an inlet, a recess, and a securing groove spaced apart from the recess extending continuously over an entire width of the housing transverse to a longitudinal direction of the housing, the reception chamber accepting the plug contacts through the inlet; and a stabilizer having a first fastening location at which the stabilizer is attached to the housing, the recess receiving the stabilizer at the first fastening location, and a second fastening location at which the stabilizer is attached to the cable, the stabilizer composed of a dimensionally stable material.

2. The connector insert of claim 1, wherein the stabilizer extends away from the inlet at the first fastening location.

3. The connector insert of claim 2, wherein the second fastening location is spaced apart from the inlet.

4. The connector insert of claim 1, wherein the stabilizer has side walls forming a trough between the first and second fastening locations.

5. The connector insert of claim 4, wherein the wires are positioned in the trough.

6. The connector insert of claim 1, wherein the stabilizer is composed of a magnetically soft material.

7. The connector insert of claim 1, wherein the stabilizer surrounds the at least one reception chamber at the first fastening location.

8. The connector insert of claim 1, wherein the housing and stabilizer are crimped together at the first fastening location.

9. The connector insert of claim 8, wherein the housing and stabilizer form a form-fit restricting motion in a longitudinal direction of the cable.

10. The connector insert of claim 9, wherein the stabilizer at the first fastening location is within the cubic volume of the housing.

11. The connector insert of claim 1, wherein the securing groove communicates with the at least one reception chamber.

12. A connector assembly, comprising:

a connector; and a connector insert inserted into the connector, the connector insert having a cable including a plurality of wires, a plurality of plug contacts, each plug contact attached to a wire, a housing including at least one reception chamber defining an inlet, a recess, and a securing groove spaced apart from the recess extending continuously over an entire width of the housing transverse to a longitudinal direction of the housing, the reception chamber accepting the plug contacts through the inlet, and a stabilizer including a first fastening location at which the stabilizer is attached to the housing, the recess receiving the stabilizer at the first fastening location, and a second fastening location at which the stabilizer is attached to the cable, the stabilizer composed of a dimensionally stable material.

13. The connector assembly of claim 12, wherein the connector has a housing including a foldable housing element and a retaining lug arranged on the foldable housing element.

14. The connector assembly of claim 13, wherein the at least one reception chamber accepts the retaining lug.

15. A connector assembly, comprising:

a connector having a receptacle with a retaining lug; and a connector insert inserted into the receptacle having a cable including a plurality of wires, a plurality of plug contacts, each plug contact attached to a wire, and a housing including at least one reception chamber accepting the plug contacts and a securing groove communicating with the at least one reception chamber, the securing groove extending continuously over an entire width of the housing transverse to a longitudinal direction of the housing, the retaining lug engaging the securing groove.

16. The connector assembly of claim 15, wherein the retaining lug is rigidly arranged in the receptacle and automatically driven into the securing groove when the housing is inserted into the receptacle.

17. The connector assembly of claim 16, wherein at least one of the connector insert is fixed transverse to the longitudinal direction by at least one latch, the connector has a foldable housing element by which the receptacle is at least partially lockable, or the connector has a securing element on a foldable housing element capable of blocking the triggering of the latch.

* * * * *